US007871344B1

(12) United States Patent
Massman

(10) Patent No.: US 7,871,344 B1
(45) Date of Patent: Jan. 18, 2011

(54) DART

(76) Inventor: Steven John Massman, 205 Stone Hollow Dr., Poplar Grove, IL (US) 61065

( * ) Notice: Subject to any disclaimer, the term of this patent is extended or adjusted under 35 U.S.C. 154(b) by 0 days.

(21) Appl. No.: 11/250,132

(22) Filed: Oct. 13, 2005

Related U.S. Application Data

(60) Provisional application No. 60/620,293, filed on Oct. 21, 2004.

(51) Int. Cl.
*A63B 65/02* (2006.01)

(52) U.S. Cl. ..... 473/578

(58) Field of Classification Search ..... 401/209, 401/213; 473/578; 43/6
See application file for complete search history.

(56) References Cited

U.S. PATENT DOCUMENTS

D66,390 S 1/1925 Wilkie
1,999,601 A * 4/1935 Tengel ..... 473/578
2,214,464 A * 9/1940 Jones ..... 482/20
2,408,256 A * 9/1946 Florman ..... 141/20.5
2,492,058 A * 12/1949 O'Connor ..... 401/153
2,970,838 A * 2/1961 Taggert ..... 473/577
D272,639 S 2/1984 Lee
D286,655 S 11/1986 Koyce
D297,029 S 8/1988 McCutcheon
5,009,433 A * 4/1991 Reid ..... 473/582
5,967,915 A * 10/1999 Lu et al. ..... 473/578
D435,872 S 1/2001 Blasingame
6,585,612 B1 * 7/2003 Weissmann ..... 473/578

* cited by examiner

*Primary Examiner*—John Ricci

(57) ABSTRACT

A dart with a dart tip and a cylindrical body. The tail end of the dart is smoothly contoured to promote end-over-end tumbling of the dart as it is thrown towards the dart board.

14 Claims, 4 Drawing Sheets

DART

CROSS-REFERENCES TO RELATED APPLICATIONS

This application claims the benefit of U.S. Provisional Application No. 60/620,293, filed Oct. 21, 2004.

INCORPORATION-BY-REFERENCE OF MATERIAL SUBMITTED ON A COMPACT DISC

Not Applicable.

STATEMENT REGARDING FEDERALLY SPONSORED RESEARCH OR DEVELOPMENT

Not Applicable.

BACKGROUND OF THE INVENTION

1. Field of Invention

The present invention relates to a dart for hand throwing at a dart board.

More particularly, the invention relates to a dart configured to promote end-over-end tumbling as it is thrown towards the dart board.

2. Background Art

A conventional dart for throwing at a dart board includes a generally cylindrical body with one end having a point to stick in the dart board, and the opposite end having a tail fin or other flight guiding, retarding, stabilizing or controlling structure. The dart is gripped between one or more fingers and the thumb of a player's hand, and tossed towards the dart board, with a goal of achieving relatively stable flight during its path from release to striking the dart board. Numerous configurations of hand-throwing darts are known in the art, but they all include a flight guiding, retarding, stabilizing or controlling structure to assist the user in achieving a stable flight path.

To promote interest in the game of darts, there is an ever-present need and desire for new and unique darts.

SUMMARY OF THE INVENTION

The general aim of the present invention is to provide a new and unique dart that establishes new challenges in the game of darts, to thereby promote interest in the game.

A detailed objective is to achieve the foregoing by providing a dart that is characterized, among other things, as lying entirely within an imaginary cylindrical envelope that extends coincidentally from an outer wall of the dart body, and thereby promote end-over-end tumbling of the dart during its flight from release to the dart board.

A preferred embodiment of the dart, in accordance with the invention, is a cylindrical projectile, with a body having one end open and threaded to receive a standard manufactured dart tip. The opposite end of the dart is smoothly contoured, to promote end-over-end tumbling of the dart as it is thrown towards the dart board. Unlike standard darts that minimize, or inhibit end over end rotation through the use of flights or other tail or flight guiding structure, a dart in accordance with the invention is configured without such flight guiding structure, to allow end over end rotation, thus adding more challenge to the sport. In certain preferred embodiments, the dart body is anodized for strength and appearance. The tail end portion of the dart is knurled for appearance and grip. The cylindrical body of the dart is made of aluminum, and is hollow to lessen the weight, thereby extending the life of the dart tips. The darts are such that they can be used in conjunction with standard dart boards, and dart games.

In use, a person stands a pre-determined distance from a dart board and grips one end of a dart, in accordance with the invention. The person then throws the dart at the target in such a manner that he or she tries to induce an appropriate amount of end over end spin such that the dart strikes tip first, and sticks into the board.

These and other objectives and advantages of the invention will become more apparent from the following detailed description when taken in conjunction with the accompanying drawings.

Figure 1:
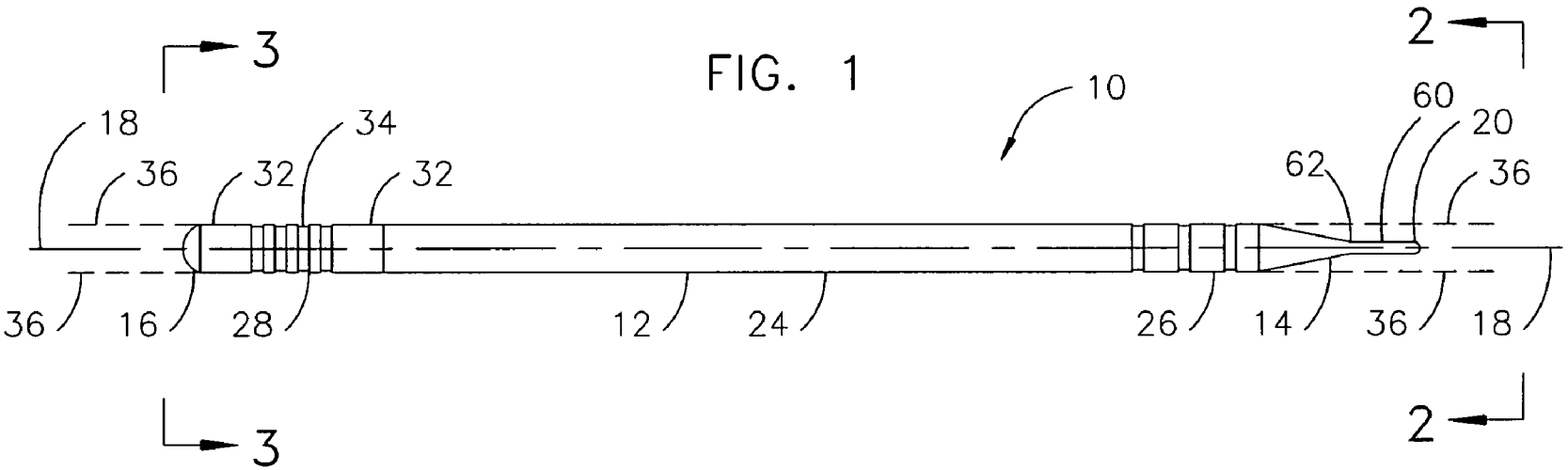
FIG. 1 is a side view of a dart incorporating the unique aspects of the present invention.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Figure 2:
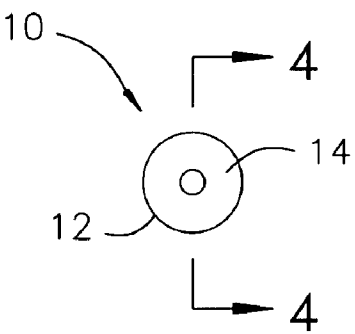
FIG. 2 is an end view, taken along the line 2-2, of the forward end of the dart shown in FIG. 1.
Figure 3:
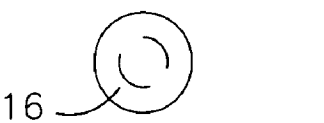
FIG. 3 is an end view, taken along the line 3-3, of the tail end of the dart shown in FIG. 1

Referring to FIGS. 1-3, there shown a dart 10, in accordance with the invention, for hand throwing at a dart board. The dart 10 includes a body 12, a tip 14, and a tail 16. The tip shown is a conventional, removable plastic dart tip with a forward rounded free end 20 establishing an integrally fixed pointed end, a generally cylindrical segment 60 extending lengthwise rearwardly along a center axis 18 integrally from the free end 20 for penetration into a dart board, a stop formation 62 at the back end of the segment 60 (e.g., the outwardly expanding taper shown on the tip rearwardly of the segment 60) to inhibit further penetration into the dart board, and an external threaded length 22 at the opposite end. The dart tip is configured for use with a conventional dart board.

The body 12 is elongated and generally cylindrical, with a continuous, substantially constant diameter, cylindrical outer wall 24 extending lengthwise along the center longitudinal axis 18, a forward end 26, and an opposite tail end 28. The body shown is established with an outer wall at a single diameter, but the body may be alternately provided with a stepped or smoothly contoured outer wall along the length thereof, with generally circular cross-sections orthogonal to the longitudinal axis. The body may be provided as a solid shaft, a hollow (tubular) barrel, or a combination thereof. One preferred body, shown in the drawings, is hollow, fabricated from aluminum, with the outer wall anodized for protective (strength and corrosion resistance) and decorative (appearance) purposes. The reduced weight of a hollow aluminum dart, as compared with, for example, a solid aluminum dart, or a thin-wall steel dart, extends the life of the dart tips as they strike the dart board, walls, floors, or other objects. The body may be fabricated from other suitable materials, such as (but not limited to) plastic or composite materials.

Figure 4:
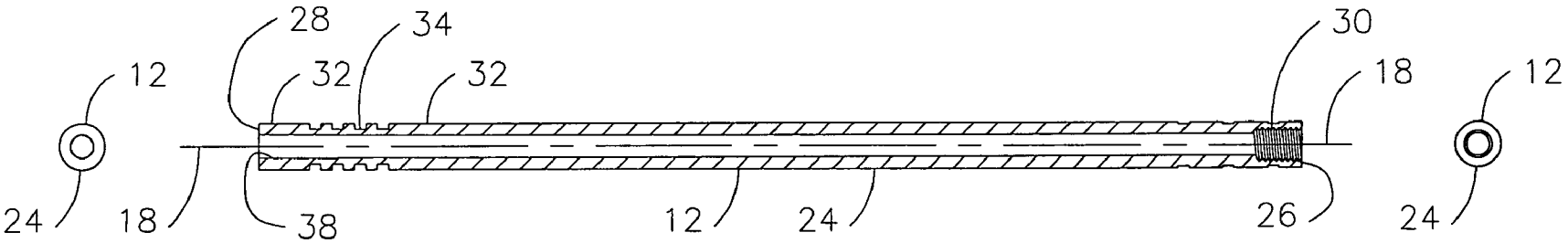
FIG. 4 is a cross-sectional view taken substantially along the line 4-4 of FIG. 2, of the body of the dart shown in FIG. 1.

As shown in the cross-sectional view in FIG. 4, the forward end 26 of the body 12 is formed with an open internal thread length 30 extending rearwardly from the free end thereof, coaxial with the outer wall 24. The threaded end 22 of the dart tip is threaded into the threaded end 30 of the body as shown in FIG. 1. In the embodiment shown, the outer wall in the tail end portion of the body is knurled as at 32, for appearance and improved gripping purposes. The embodiment shown further includes parallel, circumferential grooves 34, also for appearance and improved gripping purposes.

The tail end of a preferred dart, in accordance with the invention, is a continuously, smoothly contoured, rounded and closed end, configured to freely permit tumbling, or end-over-end rotation of the dart when it is thrown towards a dart board. This continuously, smoothly contoured, rounded closed tail end of the dart is characterized by the dart body and the tail cooperatively establishing circumferentially continuous and uninterrupted, smoothly transitioning outer surfaces at the tail end thereof (in contrast to conventional darts that include slots, cross-holes and other formations such as to accept fins and for other known purposes in the art, or that include integrally formed or securely adhered fins and the like). The tail end of the dart (and therefore, the entire dart) is thus characterized as lying entirely within an imaginary cylindrical envelope, such as indicated at 36 in dashed lines, that extends coincidentally from the outer wall of the body at the tail end thereof. Thus, the dart is characterized by the absence of structure to guide the flight of the dart along its longitudinal axis ("flight guiding structure") to promote end-over-end tumbling of the dart when thrown at the dart board, and the dart is further characterized by the absence of structure having a principle purpose of receiving or securing flight guiding structure thereto. In contrast with conventional darts that include flights or fins or other elements typically at the tail end for stabilization of the dart, and to inhibit end-over-end tumbling, as it flies towards the dart board—the unique configuration of the dart, in accordance with the invention, adds new challenges to the game.

Figure 5B:
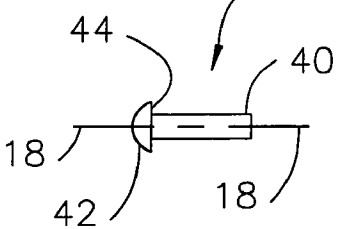
FIG. 5B is a side view of the tail of the dart shown in FIG. 1.
Figure 5A:
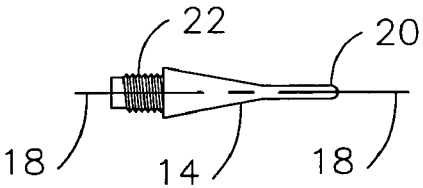
FIG. 5A is a side view of the tip of the dart shown in FIG. 1.

Referring again to FIG. 4, the tail end 28 of the body 12 shown is provided with an open bore length 38 extending axially forwardly from the free end thereof. In this instance, the bore length is established by the open end of the hollow center of the body. The tail 16, shown in detail in FIG. 5, includes a forward end stub 40 and a semi-spherical back 42. The forward end stub is provided with an outer wall configuration (shown cylindrical) for pressing snugly into the open bore 38 in the tail end of the body. The junction between the stub and the semi-spherical back is established with an outer edge or shoulder 44 that butts snugly against the free end of the body with the stub pressed into the open bore. The semi-spherical back is formed having an outer radius approximately equal to (or slightly smaller than) the radius of the outer wall 24 of the body at the tail end thereof. As a result, the tail end of the dart is a continuously, smoothly contoured, rounded closed end.

Figure 6:
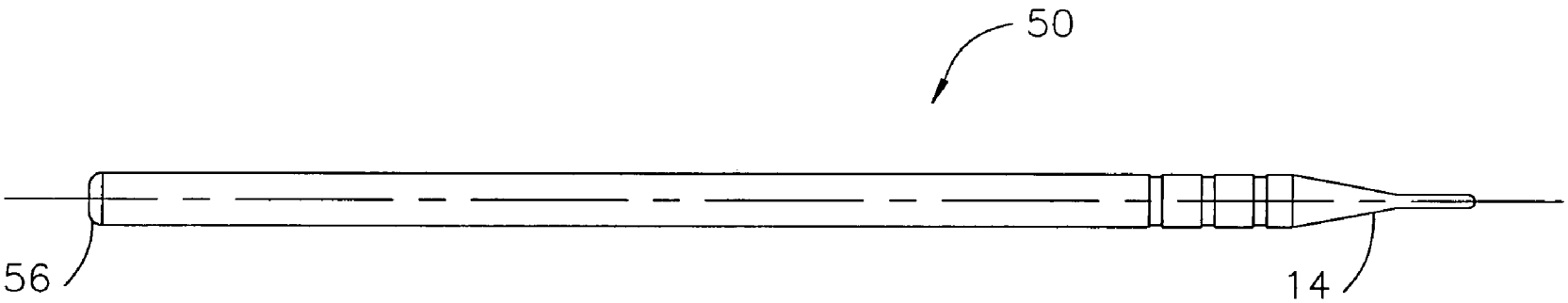
FIG. 6 is a side view of an alternate embodiment dart in accordance with the invention. (No tail insert, rounded corner at end)

The invention contemplates alternate embodiments to obtain a dart configured to not inhibit smooth, end-over-end tumbling of the dart when it is thrown towards the dart board. By way of example, a dart 50 as shown in FIG. 6 may be provided similar to dart 10, but without a tail piece such as similar to tail 16, and wherein the tail end of the body is formed with a continuous, circumferentially uninterrupted outer wall as previously described, preferably with smoothed, contoured, or rounded end 56. In an alternate embodiment, not shown, the tail end of the body is provided with an internal threaded end extending forwardly from the free end thereof, and the stub of a tail piece similar to tail 16 is provided with an external thread for threading into the tail end of the body. Persons skilled in the art may devise additional alternate embodiments that fall within the scope of the present invention.

Figure 7:
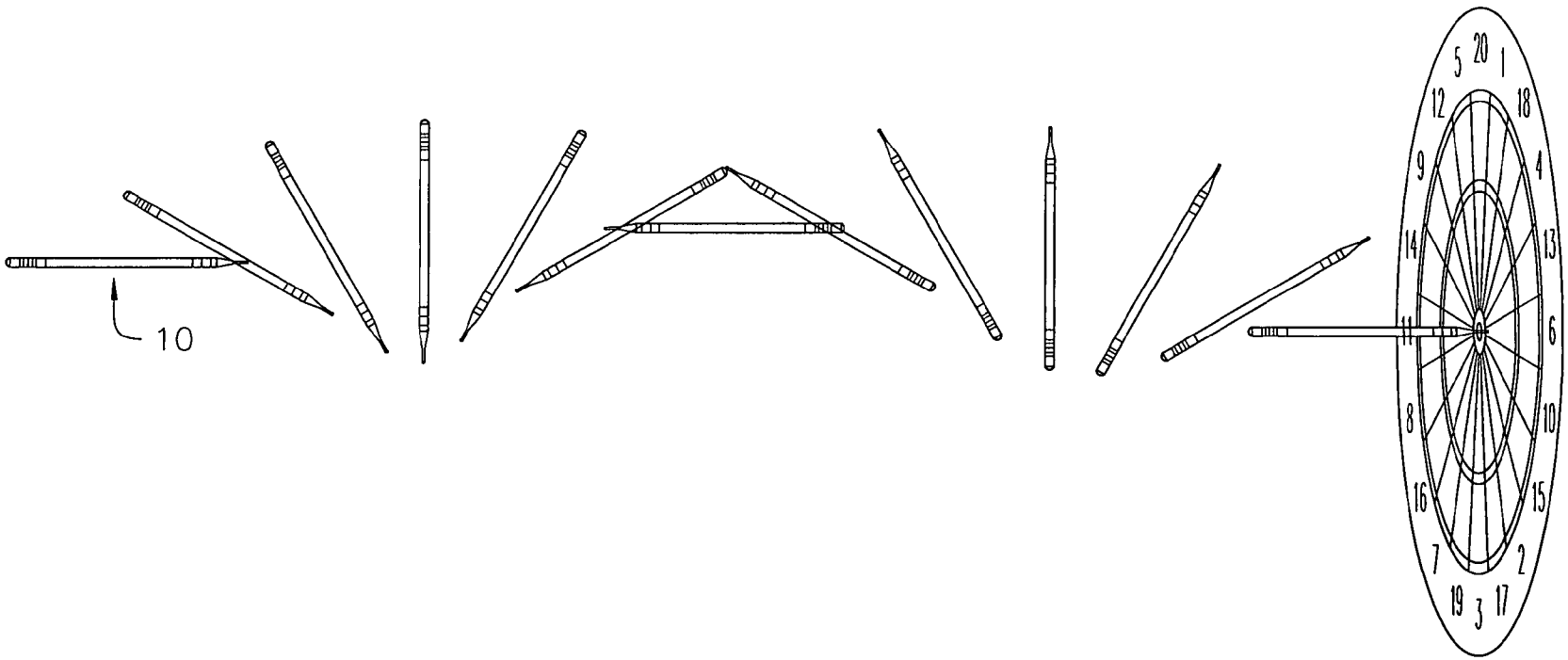
FIG. 7 is a view showing selected consecutive positions of the dart in use, as it is being hand-tossed towards a dart board.

In use, a person stands a pre-determined distance from a dart board and grips one end of the dart. The person then throws a dart, in accordance with the invention, at the target in such a manner that he or she tries to induce an appropriate amount of end-over-end spin such that the dart strikes tip first, and sticks into the dart board. FIG. 7 illustrates selected consecutive positions of the dart 10 in use, after being thrown towards the dart board.

From the foregoing, it will be apparent that the present invention brings to the art a new and unique dart that is characterized, among other things, as lying entirely within an imaginary cylindrical envelope that extends coincidentally from an outer wall of the body, such that the dart is uniquely adapted to promote play wherein the dart is intended to tumble end-over-end when thrown towards a dart board.

The invention claimed is:

1. A dart for hand throwing at a dart board, the dart comprising:

a) a tip extending lengthwise along a center longitudinal axis, the tip having a circular cross-section with opposite ends, one end of the tip having an integrally fixed point for engaging the dart board, the opposite end of the tip having a male thread length extending rearwardly from the free end thereof and with a major diameter smaller than the outer circular diameter of the tip adjacent thereto;

b) an elongated body, with a generally cylindrical outer wall extending lengthwise along the longitudinal axis, and with a forward end and an opposite tail end; the forward end of the body being formed with an open internal thread length extending rearwardly from the free end thereof, coaxial with the outer wall, and receiving the threaded end of the tip; the tail end of the body being formed with an open bore length extending forwardly from the free end thereof, coaxial with the outer wall; and c) a tail with a forward end stub, a semi-spherical back, and a shoulder therebetween; the forward end stub being pressed snugly into the open bore in the tail end of the body, the shoulder of the tail engaging snugly against the tail end of the body, and the spherical back being formed having an outer radius approximately equal to the radius of the outer wall of the body a the tail end thereof, whereby the tail end of the dart is established as a continuously, smoothly contoured, rounded closed end; and;

d) wherein the entire dart is contained within an imaginary cylindrical envelope that extends coincidentally from the outer wall of the body to promote end-over-end tumbling of the dart when thrown at the dart board.

2. A dart for hand throwing at a dart board, the dart comprising:

a) an elongated body with opposite ends, the body extending lengthwise between said ends along a center longitudinal axis;

b) a tip at the forward end of the body, the tip having an integrally fixed pointed forward free end and a generally cylindrical segment extending integrally rearwardly therefrom along said axis for penetration into the dart board; and c) a stop at the back end of said segment to inhibit further penetration into the dart board;

d) wherein the outer surface of the body, tip and tail are characterized as circumferentially continuous and uninterrupted;

e) wherein the entire dart is contained within an imaginary cylindrical envelope that extends coincidentally from an outer wall of the body to promote end-over-end tumbling of the dart when thrown at the dart board; wherein the dart is characterized by the absence of flight guiding structure and the absence of structure having a principle purpose of receiving or securing flight guiding structure thereto, and wherein the center of mass of the dart is located to promote end-over-end tumbling of the dart when thrown at the dart board.

3. The dart as defined in claim 2 in which the tip is removably threaded into said one end of the body.

4. The dart as defined in claim 3 in which the tip is a replaceable plastic tip removably threaded into the body; and wherein the tip includes the pointed free end, the segment and the stop all integrally formed together.

5. The dart as defined in claim 2 in which the tail includes a closed tail part inserted into said opposite end of the body.

6. The dart as defined in claim 2 in which the body is formed with a generally circular cross-section between said ends.

7. The dart as defined in claim 2 in which the body is generally tubular between said ends.

8. The dart as defined in claim 7 in which the tip is threaded into the wall of the tubular body.

9. The dart as defined in claim 2 in which said stop tapers outwardly upon progressing from said segment towards said body.

10. A dart for hand throwing at a dart board, the dart comprising:

a) a tip having opposite ends and extending lengthwise along a center longitudinal axis therebetween, one end of the tip having an integrally fixed point at its free end and a substantially cylindrical center segment extending therefrom for penetration into the dart board, the opposite end of the tip having a rearwardly extending male thread length; and b) an elongated body extending lengthwise along said longitudinal axis, the body having a forward end and an opposite tail end; the forward end of the body being formed with an internal thread length receiving the threaded end of the tip;

c) wherein the dart is characterized by the absence of flight guiding structure to promote end-over-end tumbling of the dart when thrown at the dart board; wherein the center of mass of the dart is located to promote end-over-end tumbling of the dart when thrown at the dart board; and d) wherein the dart is further characterized by the absence of structure having a principle purpose of receiving or securing flight guiding structure thereto.

11. The dart as defined in claim 10 in which the body is formed with a generally circular cross-section between said ends, and wherein the entire dart is contained within an imaginary cylindrical envelope that extends coincidentally from an outer wall of the body to promote end-over-end tumbling of the dart when thrown at the dart board.

12. The dart as defined in claim 10 further comprising a stop to inhibit penetration past said segment into the dart board.

13. The dart as defined in claim 12 in which the tip is a replaceable plastic tip removably threaded into the body.

14. The dart as defined in claim 12 in which the body is generally tubular between said ends; and the tip is threaded into the wall of the tubular body.

* * * * *